US005635793A

United States Patent [19]

Ochiai et al.

[11] Patent Number: 5,635,793

[45] Date of Patent: Jun. 3, 1997

[54] CATHODE-RAY TUBE AND DISPLAY UNIT USING THE CATHODE-RAY TUBE

[75] Inventors: Masatoshi Ochiai; Seiichi Takaoka, both of Saitama; Hidenori Takita, Tokyo; Tatsuhiro Hirakawa, Tokyo; Shinji Nohara, Tokyo, all of Japan

[73] Assignees: Nitto Denko Corporation, Ibaraki; Mitsubishi Denki Kabushiki Kaisha, Tokyo, both of Japan

[21] Appl. No.: 672,120

[22] Filed: Jun. 27, 1996

[30] Foreign Application Priority Data

Dec. 27, 1995 [JP] Japan ..... 7-341614

[51] Int. Cl.[6] ..... H01J 01/62; H01J 29/70; H01J 31/00; H01F 7/00

[52] U.S. Cl. ..... 313/479; 313/440; 335/210; 335/213

[58] Field of Search ..... 313/479, 413, 313/421, 430–431, 437, 440, 313; 335/442–43, 210, 213, 297, 299; 348/818, 820

[56] References Cited

U.S. PATENT DOCUMENTS 4,853,588 8/1989 Ohtsu et al. ..... 335/213 X
5,189,348 2/1993 Yokota et al. ..... 335/210 X
5,430,351 7/1995 Yokota et al. ..... 313/440
5,430,352 7/1995 Yamaguchi et al. ..... 313/440

FOREIGN PATENT DOCUMENTS 5-54834 3/1993 Japan .
5-283020 10/1993 Japan .

*Primary Examiner*—Sandra L. O'Shea
*Assistant Examiner*—Mack Haynes
*Attorney, Agent, or Firm*—Burns, Doane, Swecker & Mathis, LLP

[57] ABSTRACT

A cathode-ray tube includes an envelope in which a panel portion, a funnel portion, and a neck portion are integrally formed, and a conductor film and a deflecting yoke mounted on an outer surface of the funnel portion. A strip-type electric field reducing piece has a coated portion coated with an insulator, and an exposed conductive material portion. The coated portion is disposed between the funnel portion and the deflecting yoke, and the conductive material portion is connected to the conductor film.

4 Claims, 7 Drawing Sheets

CATHODE-RAY TUBE AND DISPLAY UNIT USING THE CATHODE-RAY TUBE

BACKGROUND OF THE INVENTION

1. Field of the Invention

The present invention relates to a cathode-ray tube and a display unit using the cathode-ray tube.

2. Description of the Prior Art

FIG. 1 is a side, partially cut-away view showing a conventional cathode-ray tube (hereinafter abbreviated as CRT). In the drawing, reference numeral 1 means the CRT, 2 is a dish-like panel portion, and 3 is a funnel-like funnel portion having a neck portion 3*a*. The panel portion 2 and the funnel portion 3 are integrally made of, for example, glass to form an envelope 100 of the CRT 1. Reference numeral 4 means an electron gun disposed in the neck portion 3*a*, 5 is a partially cylindrical aperture grill disposed along the panel portion 2 in the envelope 100, and 6 is a three-color fluorescent substance applied to an inner surface of the panel portion 2 to emit any one of blue light, green light, and red light. Reference numeral 7 means an electronic beam emitted from the electron gun 4 to emit corresponding light in the three-color fluorescent substance 6. The electron gun 4 includes three beam emitting apertures to emit the electronic beam 7 corresponding to each of the above three colors.

Reference numeral 8 means a deflecting yoke for the electronic beam 7 scanning on the fluorescent substance 6, 8*a* is a horizontal deflection coil of the deflecting yoke 8, and 8*b* is a lead wire to feed horizontal deflection current to the horizontal deflection coil 8*a*. The horizontal deflection current is sawtooth current typically ranging from 15 to 100 kHz (refer to FIG. 2).

Reference numeral 9 means a flyback transformer (hereinafter abbreviated as FBT) to supply dc voltage ranging from 23 to 27 kV, 10*a* is a conductor film of tens Ω/□, referred to as external conductive coating, which is applied to an outer surface of the funnel portion 3, and 10*b* is a conductor film of tens Ω/□, referred to as internal conductive coating, which is applied to an inner surface of the funnel portion 3. Here, the expression of n Ω/□ indicates that n Ω appears between any two points on the conductor film. The external conductive coating 10*a* and the internal conductive coating 10*b* are disposed to interpose the funnel portion 3 therebetween, and form one capacitor (of, typically, 2000 pF), thereby forming a smoothing circuit for high dc voltage from the FBT 9.

In FIG. 2, an upper graph shows the horizontal deflection current which is rapidly changed for a flyback period $T_R$. Therefore, as shown in a lower graph of FIG. 2, pulse voltage of about 1200 V is caused for the flyback period $T_R$ to be applied across the horizontal deflection coil 8*a*. In FIG. 2, a period $T_S$ means one scanning period.

Capacitance (typically ranging from 50 to 100 pF) is formed by the horizontal deflection coil 8*a* and the internal conductive coating 10*b* serving as the conductor film of tens Ω/□, which is applied to the inner surface of the funnel portion 3. Through the capacitance, pulsed voltage caused for the flyback period $T_R$ induces in the internal conductive coating 10*b* pulse voltage of several volts or less, which is identical with that shown in the lower graph of FIG. 2. An anode button 11 is connected to the FBT 9 for supplying the dc voltage ranging 23 to 27 kV, and serves as a high-voltage receive of the CRT 1. The internal conductive coating 10*b* is electrically connected to the anode button 11 and the aperture grill 5 serving as a color selecting mechanism.

Consequently, the aperture grill 5 receives the dc voltage ranging from 23 to 27 kV from the FBT 9, and the voltage induced by the pulse voltage having horizontal deflection cycle (of 15 to 100 kHz), which is developed across the horizontal deflection coil 8*a* of the deflecting yoke 8, resulting in a variation in voltage as shown in FIG. 3. In FIG. 3, reference mark $T_H$ means a horizontal cycle, $V_1$ is dc voltage of aperture grill voltage ranging from 23000 to 27000 V, and $V_2$ is fluctuating voltage of several volts.

An ac power line 12 is emitted from the panel portion 2 of the CRT 1 in a forward direction. The MPR standards are provided in Sweden as a guideline for restriction of a leakage electric field due to the ac power line 12. According to requirement in the standards, a leakage electric field of 2.5 V/m should be for a distance of 50 cm from a tube surface in a band width ranging from 2 to 400 kHz.

It is known that many electric fields in the band width from 2 to 400 kHz are caused due to horizontally deflected flyback pulses, and the electric fields are mainly caused due to the pulses from the deflecting yoke 8.

In areas other than a front surface of the CRT 1, it is possible to effectively shield the leakage electric fields by a shield material including, for example, a metallic plate. However, on the front surface of the CRT 1, it is impossible to directly employ, for example, the metallic plate for shield because an image must be displayed without an obstacle.

On the other hand, the front surface of the panel portion 2 is charged by high voltage applied to the CRT 1, and dust in the air thereby adheres to the front surface of the panel portion 2. In order to avoid the adhesion, a transparent conductive film is formed on a transparent panel which is disposed on the front surface of the CRT 1 or ahead of the CRT 1, and the transparent conductive film is grounded (a transparent conductive film method). In the transparent conductive film, a considerable shield effect can be expected on an electric field irradiated from the front surface of the CRT 1. However, formation of the transparent conductive film requires high cost.

Further, in another method of reducing the leakage electric field, the external conductive coating 10*a* is applied onto the funnel portion 3 of the CRT 1 to extend to the deflecting yoke 8 (external conductive coating extending method). FIG. 4 is an exploded perspective view showing a structure employing the external conductive coating extending method. In the drawing, a funnel-like insulator 16 is superimposed on an outer surface of a funnel-like conductive material 15, and is disposed between the funnel portion 3 and the deflecting yoke 8.

However, in the structure, there is the constraint that the conductive material 15 and the insulator 16 must be mounted before the deflecting yoke 8 is incorporated into the funnel portion 3. Further, a strip-type magnetic body referred to as spoiler is generally inserted into a gap between the funnel portion 3 and the deflecting yoke 8 to correct erroneous convergence caused in the process of ITC adjustment. However, the conductive material 15 and the insulator 16 result in difficult insertion of the magnetic body and difficult assembling operation. Besides, the funnel-like conductive material 15 and the insulator 16 decrease air permeability to increase a temperature of the deflecting yoke 8. As a result, there is a fear that reliability deteriorates.

The conventional cathode-ray tubes employing the external conductive coating extending method are disclosed in, for example, Japanese Patent Publication (Kokai) No. 5-54834, and Japanese Patent Publication (Kokai) No. 5-283020.

The conventional cathode-ray tube has the above structure in which the transparent conductive film method or the external conductive coating extending method is employed to reduce the leakage electric field from the panel portion. However, there are problems in that the former method results in high cost, and the latter method deteriorates reliability due to the increase in temperature of the deflecting yoke, and decreases an incorporation efficiency during the ITC adjustment.

SUMMARY OF THE INVENTION

In view of the foregoing, it is an object of the present invention to provide a cathode-ray tube and a display unit using the cathode-ray tube in which a leakage electric field can be reduced at low cost, an increase in temperature of a deflecting yoke can be reduced, and an incorporation efficiency is excellent.

According to the first aspect of the present invention, for achieving the above-mentioned object, there is provided a cathode-ray tube, and a display unit using, as image display means, the cathode-ray tube including a conductor film and a deflecting yoke mounted on an outer surface of a funnel portion which is formed integrally with a panel portion and a neck portion, and a strip-type electric field reducing piece in which a coated portion coated with an insulator is mounted between the funnel portion and the deflecting yoke, and an exposed conductive material portion is connected to the conductor film.

According to the second aspect of the present invention, there is provided a cathode-ray tube, and a display unit using, as image display means, the cathode-ray tube in which a strip-type electric field reducing piece is narrow on the side mounted between a funnel portion and a deflecting yoke, and becomes wider in a direction closer to the side connected to a conductor film.

According to the third aspect of the present invention, there is provided a display unit using, as image display means, the cathode-ray tube in the first or second aspect.

BRIEF DESCRIPTION OF THE DRAWINGS

The above and further objects and novel features of the invention will more fully appear from the following detailed description when the same is read in connection with the accompanying drawings, in which.

DETAILED DESCRIPTION OF THE PREFERRED EMBODIMENTS

Preferred embodiments of the invention will now be described in detail referring to the accompanying drawings.

Embodiment 1

Figure 5:
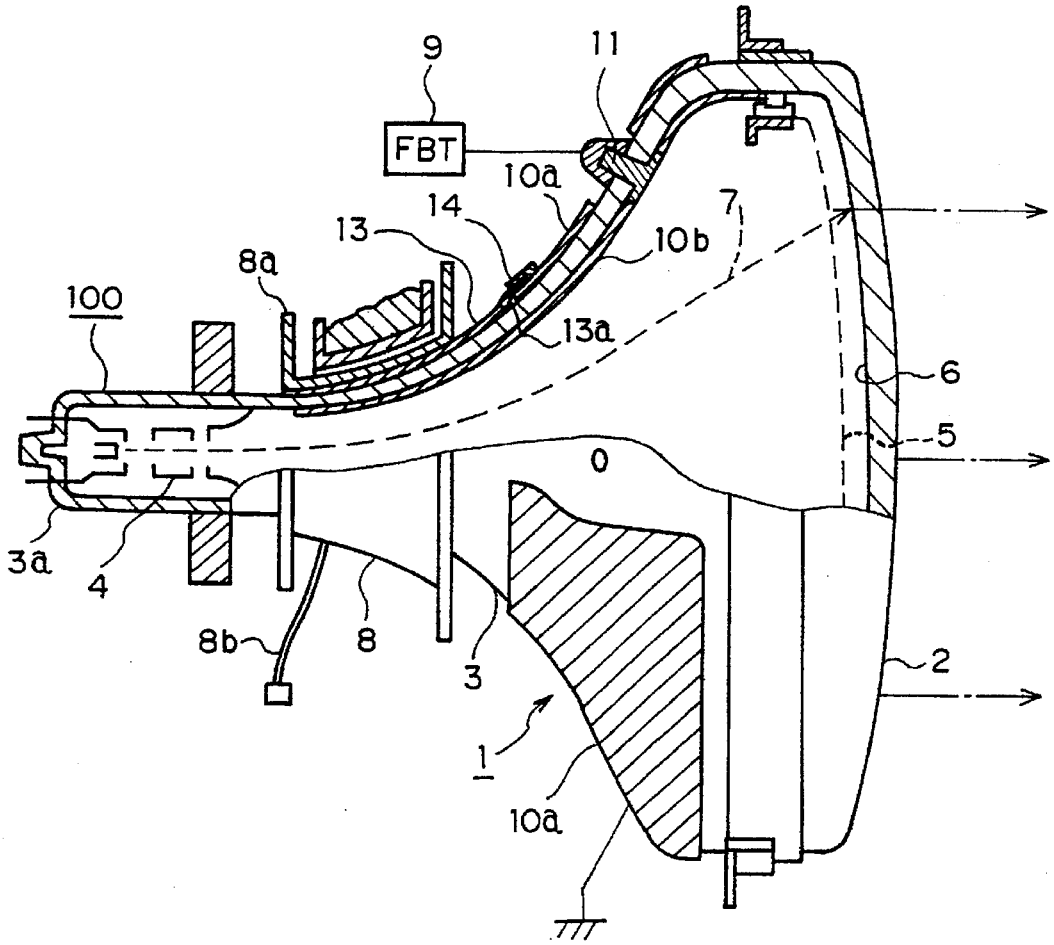
FIG. 5 is a side, partially cut-away view showing a CRT according to the embodiment 1 of the present invention.
Figure 6:
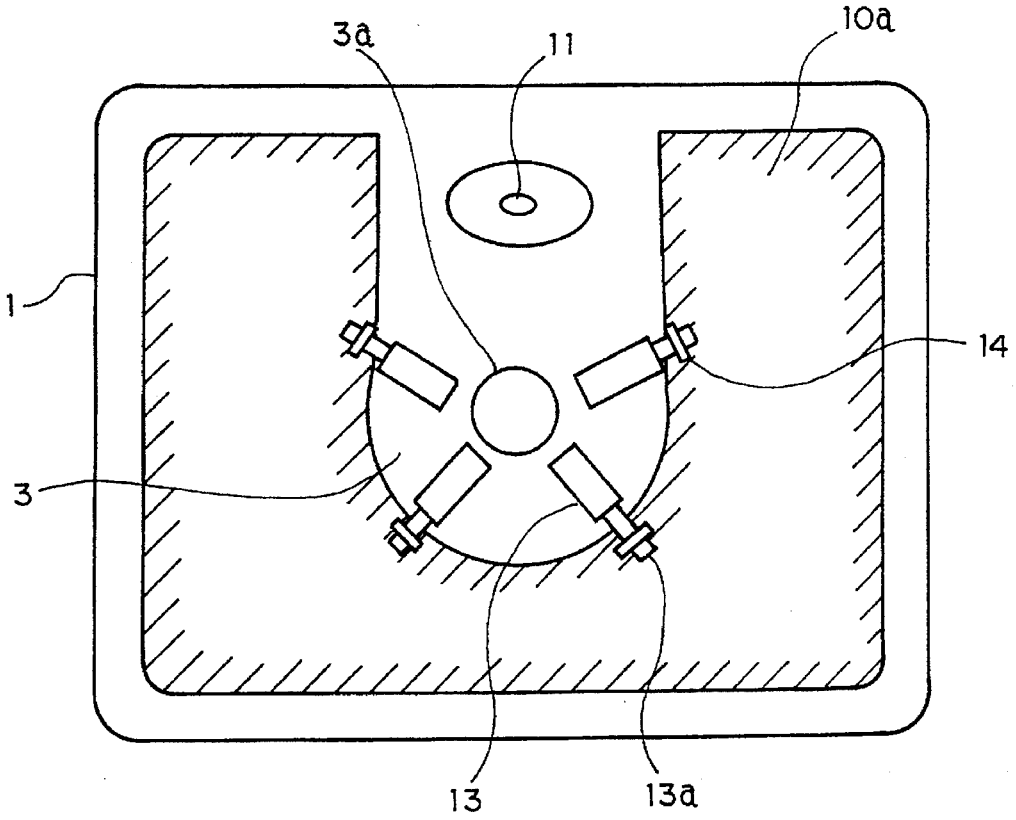
FIG. 6 is a rear view showing the CRT according to the embodiment 1 of the present invention.

FIG. 5 is a side, partially cut-away view showing a cathode-ray tube (hereinafter abbreviated as CRT) according to the embodiment 1 of the present invention, and FIG. 6 is a rear view of the CRT. In the drawings, reference numeral 1 means the CRT (cathode-ray tube), 2 is a dish-like panel portion, and 3 is a funnel-like funnel portion having a neck portion 3*a*. The panel portion 2 and the funnel portion 3 are integrally made of, for example, glass to form an envelope 100 of the CRT 1.

Reference numeral 4 means an electron gun disposed in the neck portion 3*a*, 5 is a partially cylindrical aperture grill disposed along the panel portion 2 in the envelope 100, and 6 is a three-color fluorescent substance applied to an inner surface of the panel portion 2 to emit any one of blue light, green light, and red light. Reference numeral 7 means an electronic beam emitted from the electron gun 4 to emit corresponding light in the three-color fluorescent substance 6. The electron gun 4 includes three beam emitting apertures to emit the electronic beam 7 corresponding to each of the above three colors.

Reference numeral 8 means a deflecting yoke for the electronic beam 7 scanning on the fluorescent substance 6, 8*a* is a horizontal deflection coil of the deflecting yoke 8, and 8*b* is a lead wire to feed horizontal deflection current to the horizontal deflection coil 8*a*. The horizontal deflection current is sawtooth current typically ranging from 15 to 100 kHz.

Reference numeral 9 means an FBT to supply dc voltage ranging from 23 to 27 kV, 10*a* is a conductor film of tens Ω/□, referred to as external conductive coating, which is applied to an outer surface of the funnel portion 3, and 10*b* is a conductor film of tens Ω/□, referred to as internal conductive coating, which is applied to an inner surface of the funnel portion 3. The external conductive coating 10*a* and the internal conductive coating 10*b* are disposed to interpose the funnel portion 3 therebetween, and form one capacitor (of, typically, 2000 pF), thereby forming a smoothing circuit for high dc voltage from the FBT 9.

Reference numeral 11 means an anode button connected to an output terminal of the FBT 9 so as to serve as a high-voltage receive. The internal conductive coating 10*b* is electrically connected to the anode button 11 and the aperture grill 5 serving as a color selecting mechanism. Reference numeral 13 means electric field reducing pieces, and 14 is fixing tapes to fix the electric field reducing pieces 13 onto the outer surface of the funnel portion 3.

Figure 7:
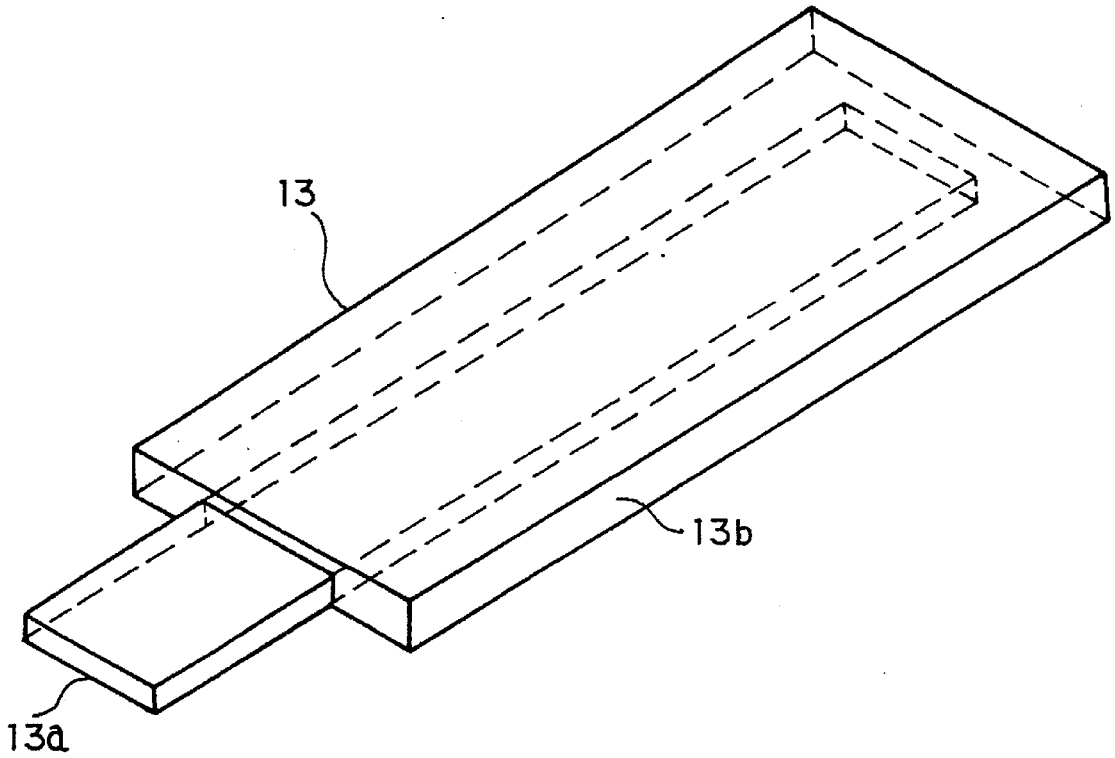
FIG. 7 is a perspective view showing an electric field reducing piece applied to the CRT according to the embodiment 1 of the present invention.
Figure 8:
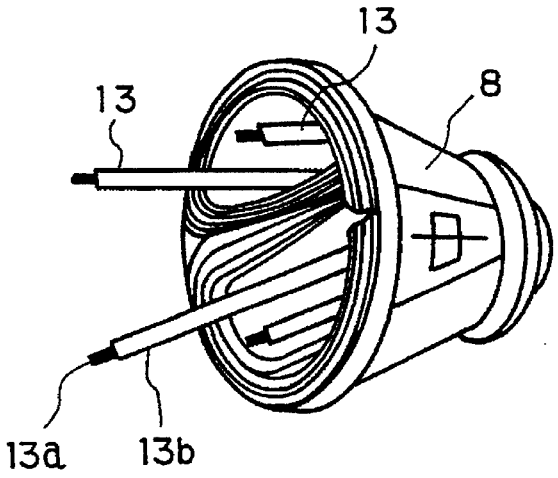
FIG. 8 is a perspective view showing a state in which the electric field reducing pieces shown in FIG. 7 are attached to a deflecting yoke.

FIG. 7 is a perspective view showing the electric field reducing piece 13, and FIG. 8 is a perspective view showing a state in which the electric field reducing pieces 13 are attached to the deflecting yoke 8. In the electric field reducing piece 13, the thin non-metallic and non-magnetic conductor piece (conductive material portion) 13*a* such as carbon has resistance of about $10^1$ to $10^2$ Ω/□, and is coated with a thin insulating piece (coating portion) 13*b* such as polyester film, and one end of the conductor piece 13 is externally exposed without shield. In the illustration, the electric field reducing pieces 13 are disposed on the outer surface of the funnel portion 3 with regular intervals (i.e., the pieces are disposed one by one in the first, second, third, and fourth quadrants). Further, the exposed conductor pieces 13*a* of the electric field reducing pieces 13 are electrically connected to the external conductive coating 10*a*, and are fixed to the outer surface of the funnel portion 3 through the fixing tapes 14.

Because of a strip form of the electric field reducing piece 13, it is extremely easy to attach the electric field reducing pieces 13 irrespective of before or after the deflecting yoke 8 is inserted and incorporated into the funnel portion 3. Further, a strip-type magnetic body (not shown) referred to as spoiler is typically inserted into a gap between the funnel portion 3 and the deflecting yoke 8 to correct erroneous convergence caused in the process of ITC adjustment. In this case, since the electric field reducing piece 13 has the strip form as described above, the electric field reducing piece 13 never interferes with insertion of the magnetic body.

A description will now be given of the operation.

Figure 1:
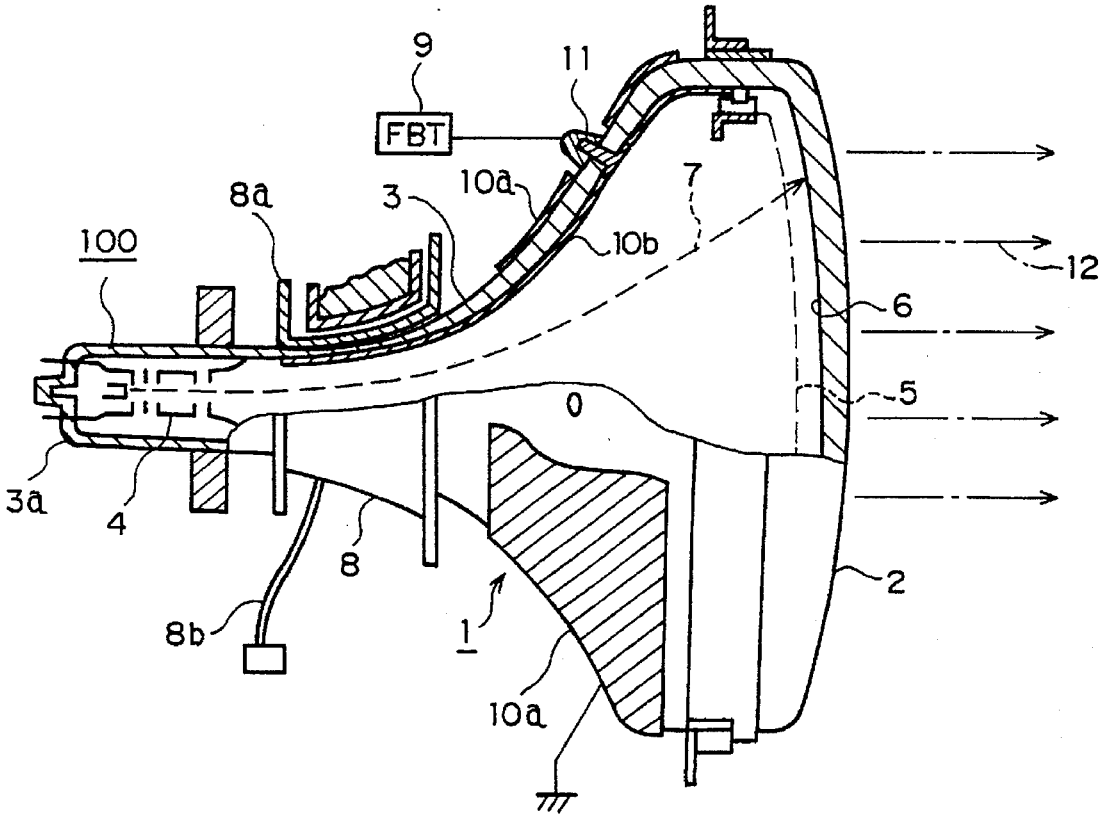
FIG. 1 (PRIOR ART)
FIG. 1 is a side, partially cut-away view showing a conventional CRT.
Figure 3:
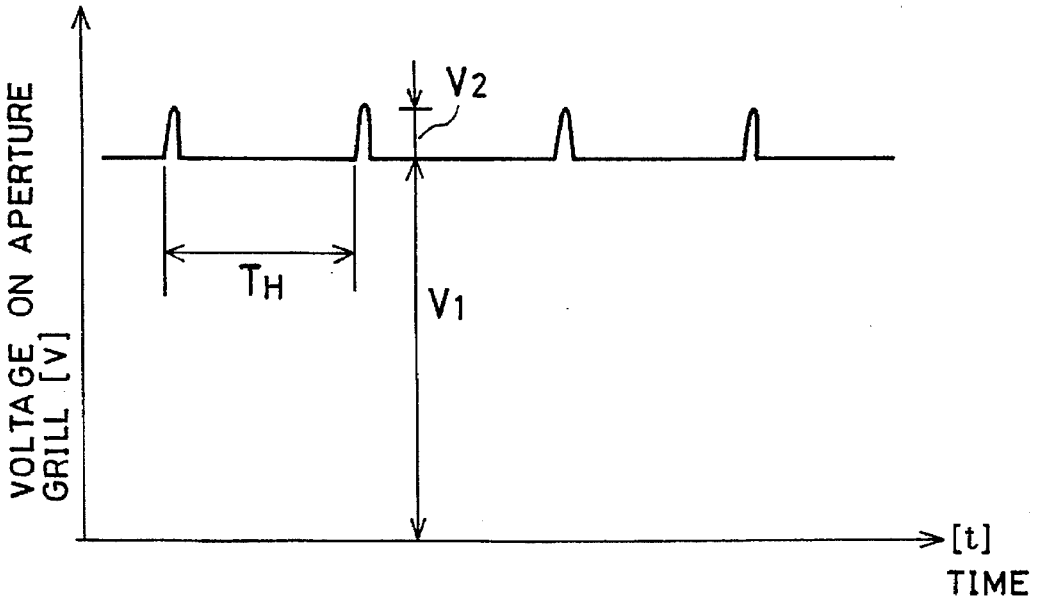
FIG. 3 is a waveform diagram of voltage applied to an aperture grill of the conventional CRT.
Figure 2:
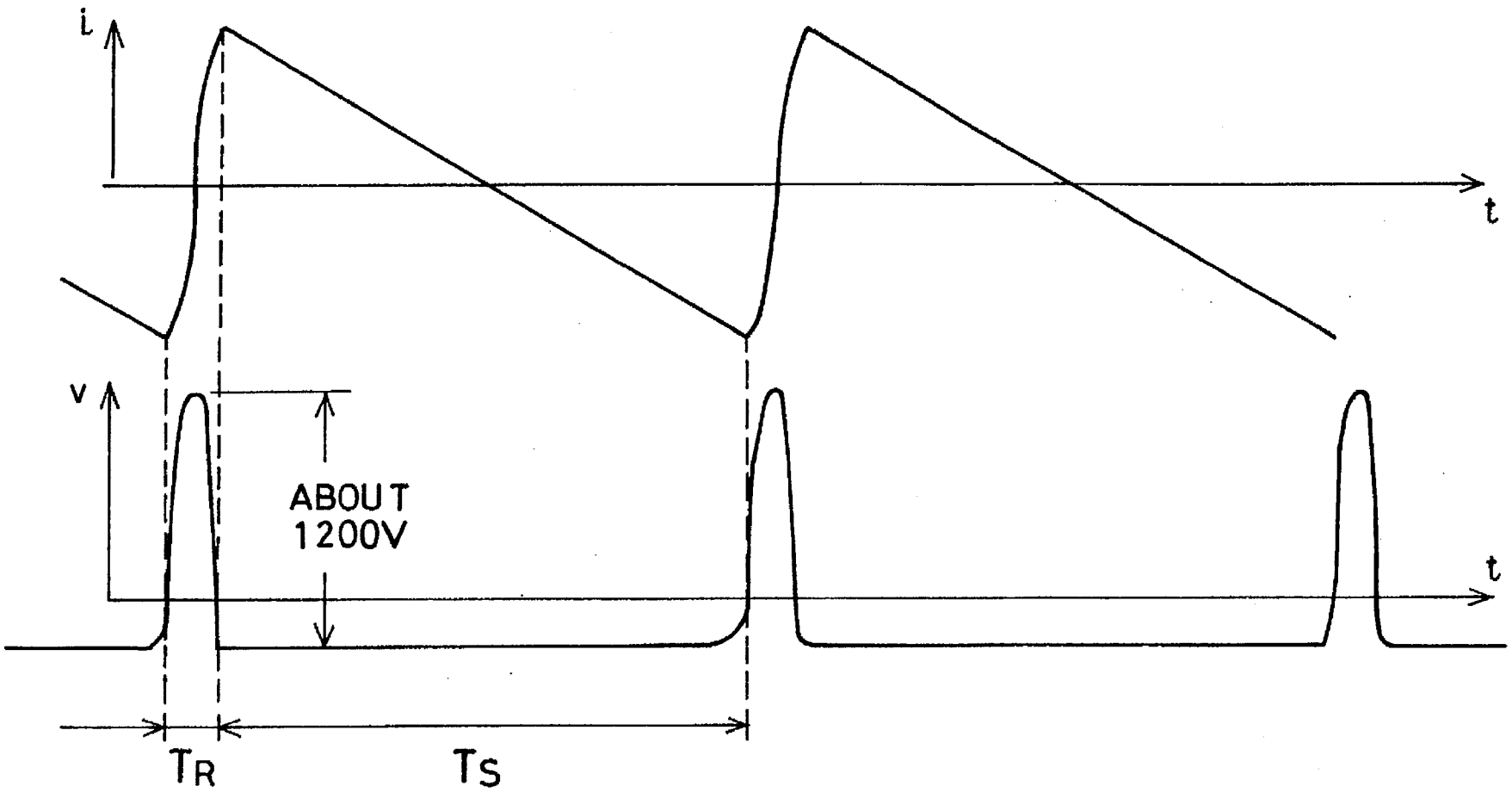
FIG. 2 is waveform diagrams of deflection current flowing in a horizontal deflection coil and coil terminal voltage in the conventional CRT.
Figure 4:
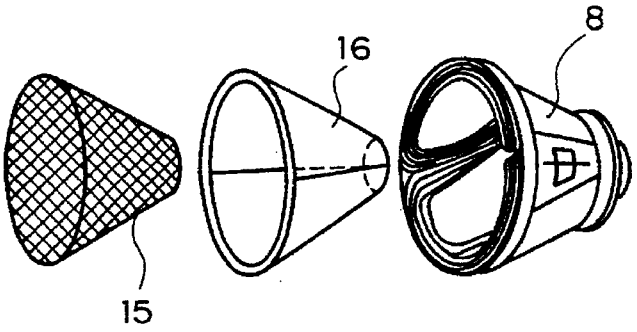
FIG. 4 (PRIOR ART)
FIG. 4 is an explanatory view of an electric field reducing apparatus according to a conventional external conductive coating extending method.
Figure 9:
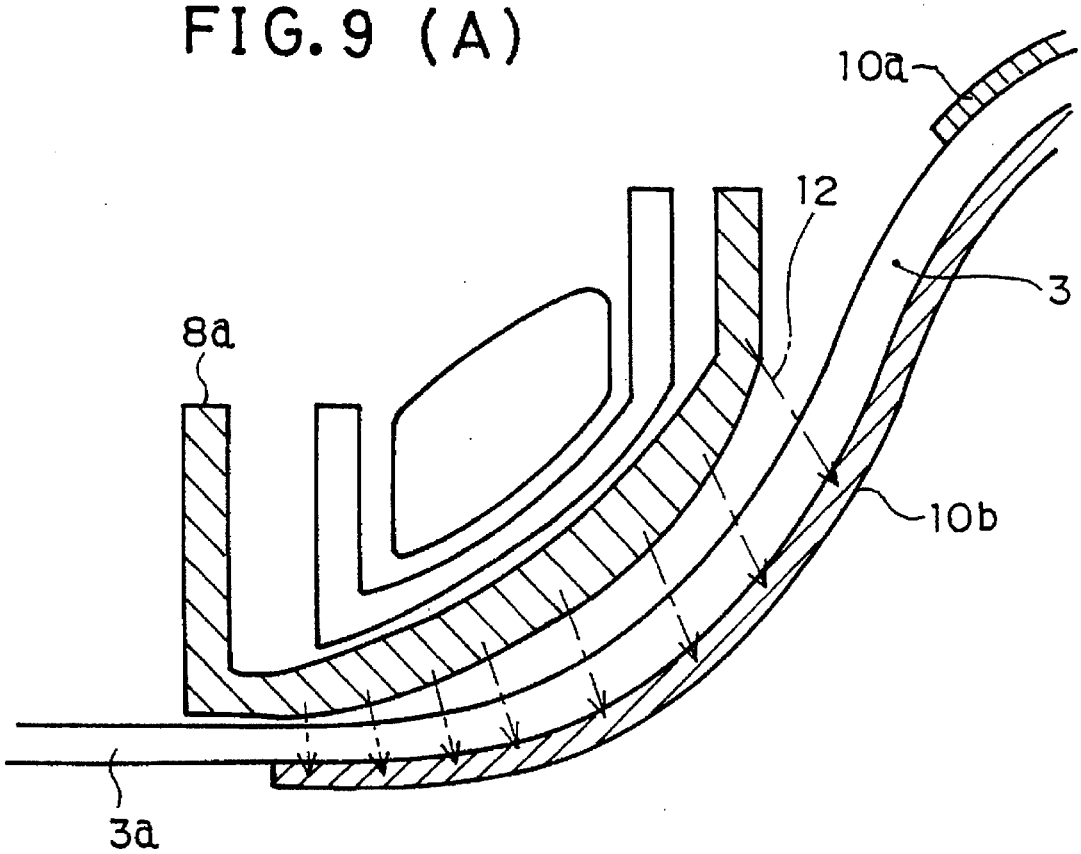
FIGS. 9(A) and 9(B) are diagrams for illustrating an electric field reducing effect in the CRT according to the embodiment 1 of the present invention.
Figure 9:
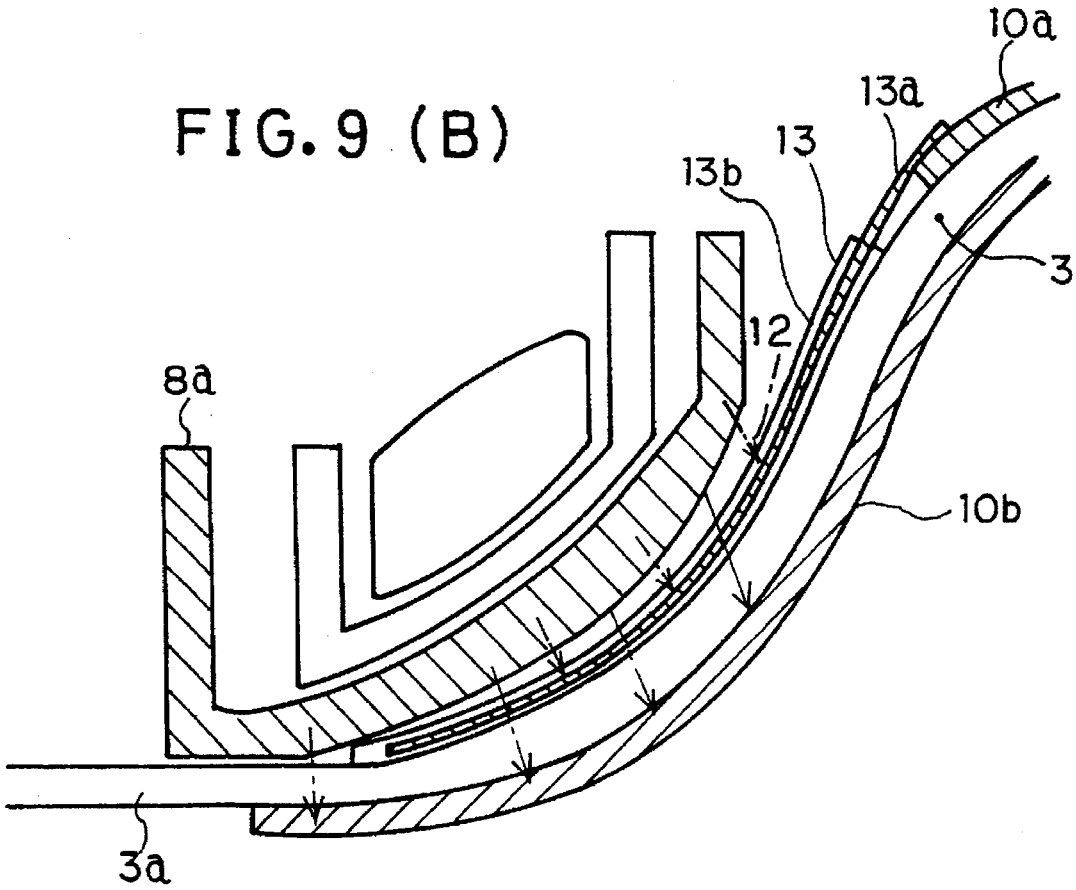

FIGS. 9(A) and 9(B) are diagrams for illustrating an electric field reducing effect. FIG. 9(A) is an enlarged sectional view of a funnel portion 3 of a conventional CRT 1 without the electric field reducing pieces 13, and FIG. 9(B) is an enlarged sectional view of the funnel portion 3 of the CRT 1 with the electric field reducing pieces 13 according to the present invention. As is obvious from the drawings, in the conventional CRT 1 without the electric field reducing piece 13 shown in FIG. 9(A), ac power lines 12 are caused due to pulse voltage of the horizontal deflecting coil 8*a*, and can entirely pass through the funnel portion 3 to be terminated at the internal conductive coating 10*b*. Thereby, as shown in FIG. 1, the ac power line 12 is forward emitted from a panel portion 2 to cause a large leakage electric field.

In contrast, in the CRT 1 with the electric field reducing pieces 13 shown in FIG. 9(B) according to the present invention, the conductor pieces 13*a* serving as component parts of the electric field reducing pieces 13 are electrically connected to the external conductive coating 10*a* at the ground potential. Consequently, almost the entire ac power line 12 caused due to the pulse voltage of the horizontal deflecting coil 8*a* is terminated at the conductor pieces 13*a*. As a result, it is possible to decrease a rate of the ac power line 12 passing through the funnel portion 3 to be terminated at the internal conductive coating 10*b*.

As set forth above, according to the embodiment 1, the rate of the ac power line 12 terminated at the internal conductive coating 10*b* can be decreased, thereby decreasing induced pulse voltage applied to the aperture grill 5 through the internal conductive coating 10*b*. As a result, there is an effect in that the ac power lines 12 forward emitted from the panel portion 2 can also be decreased, and the leakage electric field can be reduced. Further, it is possible to obtain the strip-type electric field reducing piece 13 at low cost, and extremely easily attach the electric field reducing pieces 13 irrespective of before or after the deflecting yoke 8 is inserted and incorporated into the funnel portion 3. In addition, the strip form can provide good air permeability of the deflecting yoke 8 after the incorporation, and can reduce an increase in temperature, resulting in enhancement of reliability.

Embodiment 2

Figure 10:
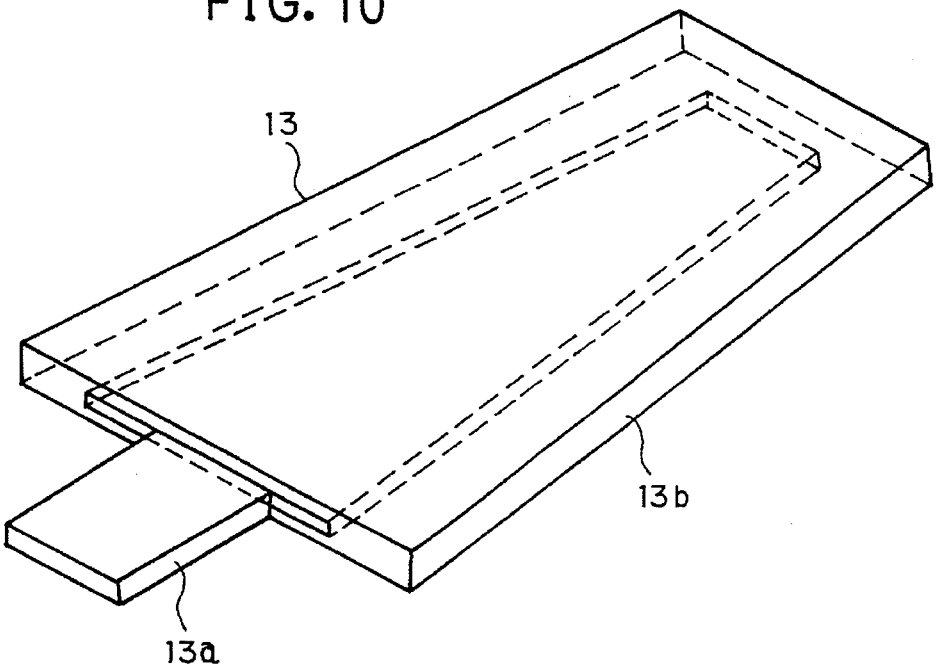
FIG. 10 is a perspective view showing an electric field reducing piece according to the embodiment 2 of the present invention.

FIG. 10 shows a form of an electric field reducing piece 13 according to the embodiment 2 of the present invention. A conductor piece 13*a* has one end which is narrow, and becomes wider in a direction closer to the other end. Except an exposed conductor portion at a wider end, the conductor piece 13*a* is coated with an insulating piece 13*b*. Thus, the electric field reducing piece is narrow on the side mounted between a funnel portion 3 and a deflecting yoke 8, and becomes wider in a direction closer to the side connected to an external conductive coating 10*a*.

As set forth above, according to the embodiment 2, the electric field reducing piece 13 is wide on the exposed conductor side which is electrically connected to an external conductive coating 10*a*. As a result, it is possible to obtain effects in that ac power lines 12 can effectively be terminated, and an inserting operation is facilitated because of the narrow width of the electric field reducing piece on the side inserted between the funnel portion 3 and the deflecting yoke 8.

Embodiment 3

Figure 11:
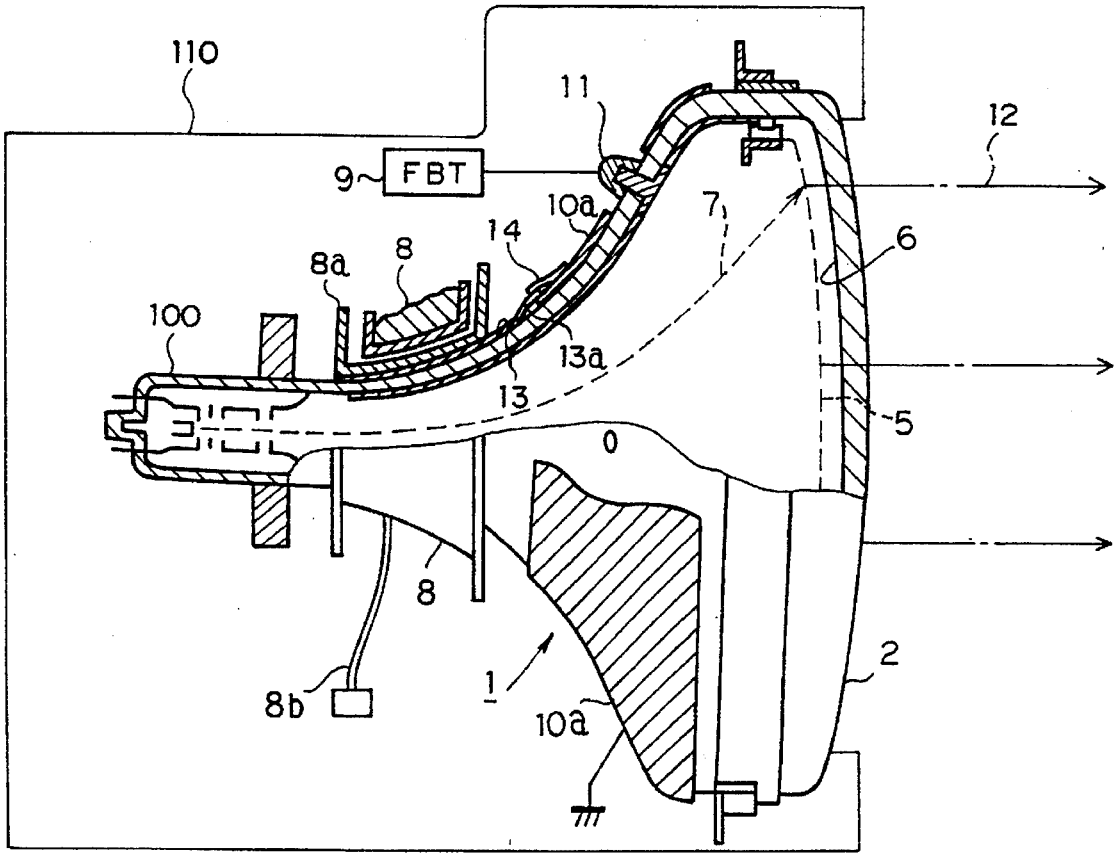
FIG. 11 is a side, partially cut-away view showing a display unit employing a CRT according to the embodiment 2 of the present invention.

FIG. 11 shows a display unit according to the embodiment 3 of the present invention. A CRT 1 serving as image display means is incorporated in an external case 110 to form the display unit. In the embodiment, there is an effect of obtaining the display unit in which an incorporation efficiency is excellent, and a leakage electric field can be reduced at low cost.

Though the above embodiments have been described with reference to the CRT of aperture grill type, it is to be noted that a CRT of shadow-mask type can provide the same effects as those in the above discussion.

As set forth above, according to the first aspect of the present invention, there is provided the display unit including the strip-type electric field reducing pieces in which the coated portion coated with the insulator is interposed between the funnel portion and the deflecting yoke, and the exposed conductive material portion is connected to the conductor film. The rate of the ac power lines terminated at the internal conductive coating can be decreased, thereby decreasing the induced pulse voltage applied to the aperture grill through the internal conductive coating. As a result, the ac power lines forward emitted from the panel portion can also be decreased, and the leakage electric field can be reduced. Further, it is possible to obtain the electric field reducing piece at low cost because of its strip form, and extremely easily attach the electric field reducing piece irrespective of before or after the deflecting yoke is inserted and incorporated into the funnel portion. In addition, there are effects in that, for example, the strip form can provide good air permeability of the deflecting yoke after the incorporation, and can reduce the increase in temperature, resulting in the enhancement of reliability.

Further, according to the second aspect of the present invention, the strip-type electric field reducing piece is narrow on the side mounted between the funnel portion and the deflecting yoke, and becomes wider in a direction closer to the side connected to the conductor film. As a result, there are effects in that the ac power lines can effectively be terminated, less inserting efficiency deteriorates, and the inserting operation is facilitated because of the narrow width of the electric field reducing piece on the side inserted between the funnel portion and the deflecting yoke.

Further, according to the third aspect of the present invention, there is provided the display unit including, as image display means, the cathode-ray tube in the embodiment 1 or 2. As a result, it is possible to provide the display unit in which the incorporation efficiency is excellent, and the leakage electric field can be reduced at low cost.

While preferred embodiments of the invention have been described using specific terms, such description is for illustrative purposes only, and it is to be understood that changes and variations may be made without departing from the spirit or scope of the following claims.

What is claimed is:

1. A cathode-ray tube comprising:

an envelope in which a panel portion, a funnel portion, and a neck portion are integrally formed;

a conductor film and a deflecting yoke mounted on an outer surface of the funnel portion; and a strip-type electric field reducing piece in which a coated portion coated with an insulator is inserted and disposed between the funnel portion and the deflecting yoke, and an exposed conductive material portion is connected to the conductor film.

2. A cathode-ray tube according to claim 1, wherein the strip-type electric field reducing piece is narrow on the side inserted between the funnel portion and the deflecting yoke, and becomes wider in a direction closer to the side connected to the conductor film.

3. A display unit comprising a cathode-ray tube as image display means, and the cathode-ray tube including:

an envelope in which a panel portion, a funnel portion, and a neck portion are integrally formed;

a conductor film and a deflecting yoke mounted on an outer surface of the funnel portion; and a strip-type electric field reducing piece in which a coated portion coated with an insulator is inserted and disposed between the funnel portion and the deflecting yoke, and an exposed conductive material portion is connected to the conductor film.

4. A display unit according to claim 3, wherein the strip-type electric field reducing piece is narrow on the side inserted between the funnel portion and the deflecting yoke, and becomes wider in a direction closer to the side connected to the conductor film.

* * * * *